US007114983B2

(12) United States Patent
Fukatsu et al.

(10) Patent No.: US 7,114,983 B2
(45) Date of Patent: Oct. 3, 2006

(54) CONNECTOR

(75) Inventors: Yukihiro Fukatsu, Yokkaichi (JP); Kiyofumi Ichida, Yokkaichi (JP); Yukihiro Toyoda, Yokkaichi (JP); Yasushi Okayasu, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 11/066,647

(22) Filed: Feb. 24, 2005

(65) Prior Publication Data

US 2005/0186842 A1 Aug. 25, 2005

(30) Foreign Application Priority Data

Feb. 25, 2004 (JP) ..... 2004-049572
Jul. 21, 2004 (JP) ..... 2004-213445

(51) Int. Cl.
*H01R 13/627* (2006.01)

(52) U.S. Cl. ..... 439/358; 439/358

(58) Field of Classification Search ..... 439/357, 439/358, 372, 382, 385, 732
See application file for complete search history.

(56) References Cited

U.S. PATENT DOCUMENTS 4,333,699 A * 6/1982 Brorein ..... 439/592
5,336,540 A 8/1994 Kato et al.
5,848,456 A * 12/1998 Sjoqvist ..... 24/618
6,419,515 B1 * 7/2002 Okayasu ..... 439/358
6,461,187 B1 * 10/2002 Chen ..... 439/358
6,688,907 B1 * 2/2004 Yamaoka et al. ..... 439/489

* cited by examiner

*Primary Examiner*—Phuong Dinh
(74) *Attorney, Agent, or Firm*—Gerald E. Hespos; Anthony J. Casella

(57) ABSTRACT

A female housing (20) has a resiliently deformable lock arm (38), whereas a male housing (10) is provided with an interlocking portion (13). During the connection of the two housings (10, 20), the lock arm (38) is temporarily deformed while being held in sliding contact with the interlocking portion (13). When the two housings (10, 20) are properly connected, the lock arm (38) is restored resiliently to engage the interlocking portion (13). A front surface (14) of the interlocking portion (13) to face the lock arm (38) during a connecting process is arcuate. Thus, only a widthwise middle (14*a*) of the interlocking portion (13) slides in contact with the lock arm (38) during a connecting operation.

17 Claims, 14 Drawing Sheets

CONNECTOR

BACKGROUND OF THE INVENTION

1. Field of the Invention

The invention relates to a connector.

2. Description of the Related Art

U.S. Pat. No. 5,336,540 discloses a connector with male and female housings that are connectable with each other. The female housing has a lock arm and a male housing has an engaging portion that is engageable with the lock arm. The lock arm moves onto the front surface of the engaging portion during connection of the housings and deforms temporarily. The lock arm restores resiliently to engage the rear surface of the engaging portion when the housings are connected properly.

The housings have cavities for receiving terminal fittings and locks are formed in the cavities. The outer wall of the terminal fitting pushes the rear surface of the lock to deform the lock temporarily as the terminal fitting is inserted into the cavity. The lock is restored resiliently and engages the outer wall of the terminal fitting when the terminal fitting reaches a proper depth.

A wider lock arm would generate a higher holding force between the housings. However, a wider lock arm generates a larger frictional resistance during a connecting process. Similarly, a wider lock would generate a higher holding force on the terminal fitting. However, a wider lock would increase the force required to insert the terminal fitting into the cavity.

A connector used in an engine compartment of an automotive vehicle is subjected to frequent vibration. Accordingly, the two housings may shake in directions intersecting the connecting direction, and the connected terminal fittings may abrade against each other.

An object of the invention is to prevent two housings from making loose movements in directions intersecting the connecting direction.

Another object of the invention is to facilitate assembly of the connectors and mating of two connectors.

SUMMARY OF THE INVENTION

The invention is directed to a connector with first and second housings that are connectable with each other. A resiliently deformable lock arm is provided on one housing and an interlocking portion is provided on the other housing. The lock arm slides in contact with the interlocking portion in the process of connecting the housings and is deformed temporarily. However, the lock arm restores resiliently to engage the interlocking portion when the housings are connected properly. A partial sliding contact is provided on at least one of facing surfaces of the lock arm and the interlocking portion and slides in contact with the mating facing surface in the connecting process. The sliding contact area is smaller than the width of the facing surface, and frictional resistance between the facing surfaces during the connecting process is reduced. As a result, the connecting operation is easier.

The housing preferably has at least one cavity and a resiliently deformable lock is formed in the cavity. A terminal fitting can be inserted into the cavity and deforms the lock during the insertion. However, the lock restores resiliently to engage an engageable portion of the terminal fitting when the terminal fitting reaches a proper depth. A partial sliding contact is provided on one of facing surfaces of the lock and the engageable portion and slides in contact with the mating facing surface during connection. The partial sliding contact preferably slides in contact with the mating facing surface when the lock slides in contact with the engageable portion. A sliding contact area is smaller than a width of the facing surface. Therefore, frictional resistance between the facing surfaces during insertion is reduced, and the insertion is easier.

At least one facing surface may be at least partly arcuate and the partial sliding contact portion may be a linear area on the arcuate surface. The partial sliding contact preferably slides in contact with the mating facing surface along connecting and separating directions. The linear configuration of the sliding contact area along the connecting and separating directions ensures a low frictional resistance.

Each facing surface may be formed by a plurality of flat intersecting surfaces. The partial sliding contact may be a meeting area of the flat surfaces that can slide in contact with the mating facing surface.

The first housing is fittable into the second housing. A loose movement preventing portion preferably bulges at a rear end of a connection area of the first housing and is configured for contacting the second housing for preventing the housings from making loose movements in directions intersecting the connecting direction. The disposition of the loose movement preventing portion at the rear end of the connection area ensures that a connecting force increases only at a final stage of the connecting process.

The outer surface of the first housing preferably has curved corners and substantially straight surfaces connecting the curved corners. The loose movement-preventing portion preferably is on the straight surface. The dimensions of the loose movement-preventing portion can be controlled more accurately on the straight surface. Accordingly, contact pressure on the second housing during the connecting operation is controlled more accurately than if the loose movement-preventing portion was on a curved surface.

The second housing preferably has guide grooves with straight surfaces aligned along the connecting direction. The first housing preferably has guide ribs with straight surfaces aligned along the connecting direction. The loose movement preventing portions may be on the straight surfaces of the guide grooves or the guide ribs.

The second housing preferably has a resilient member for preventing the housings from making loose movements in the connecting and separating directions and in directions intersecting the connecting and separating directions. The front end of the first housing preferably compresses the resilient member as the housings are connected.

DETAILED DESCRIPTION OF THE PREFERRED EMBODIMENTS

A first embodiment of the invention is described with reference to FIGS. 1 to 9 and relates to a locking construction of a watertight connector. The watertight connector has male and female connectors M, F connectable with each other along a connecting direction CD. Sides of the connectors F, M to be connected are referred to as the front sides and reference is made to all the figures except FIGS. 4, 7 and 9 concerning the vertical direction.

Figure 1:
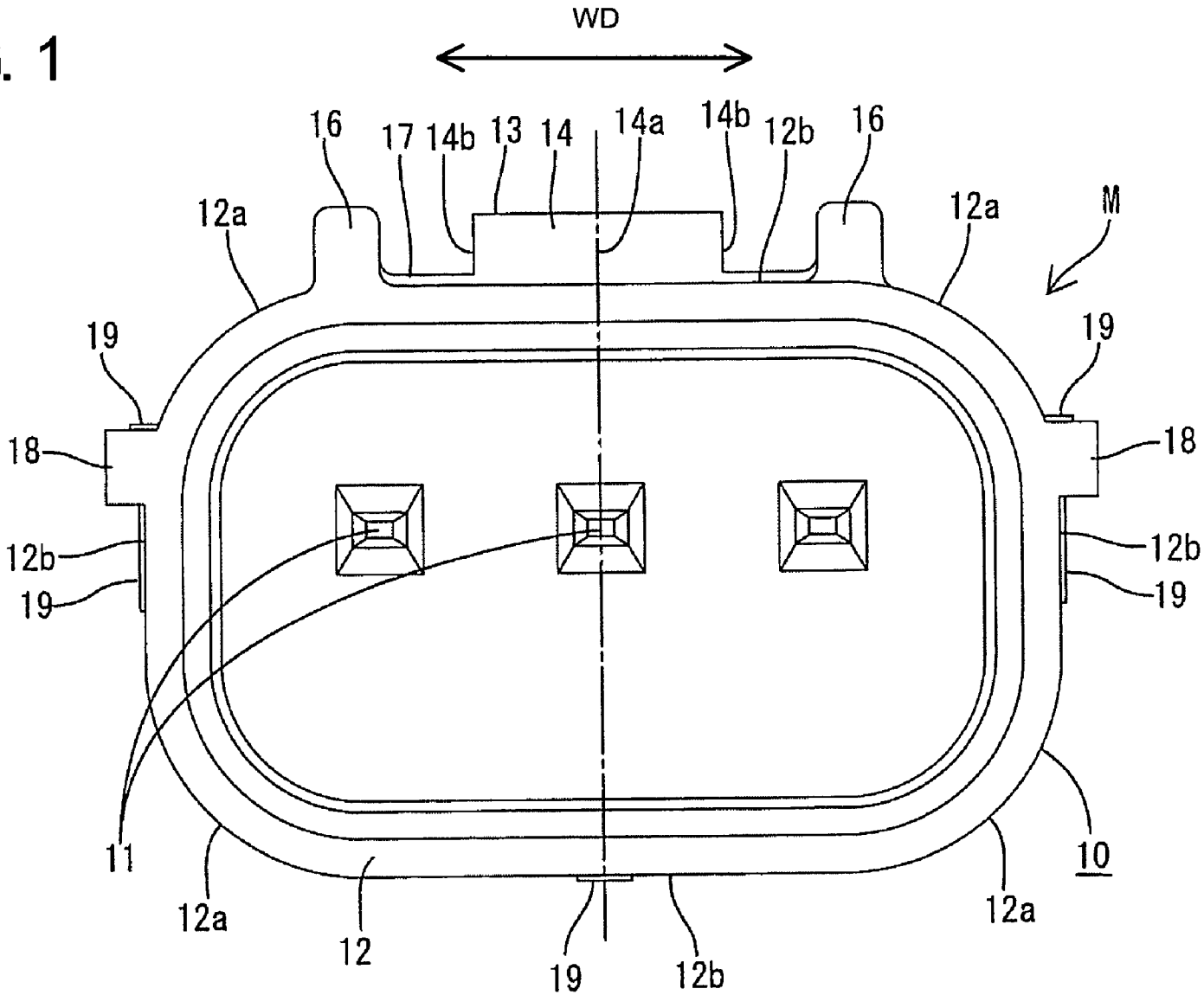
FIG. 1 is a front view of a male housing according to a first embodiment of the invention.
Figure 3:
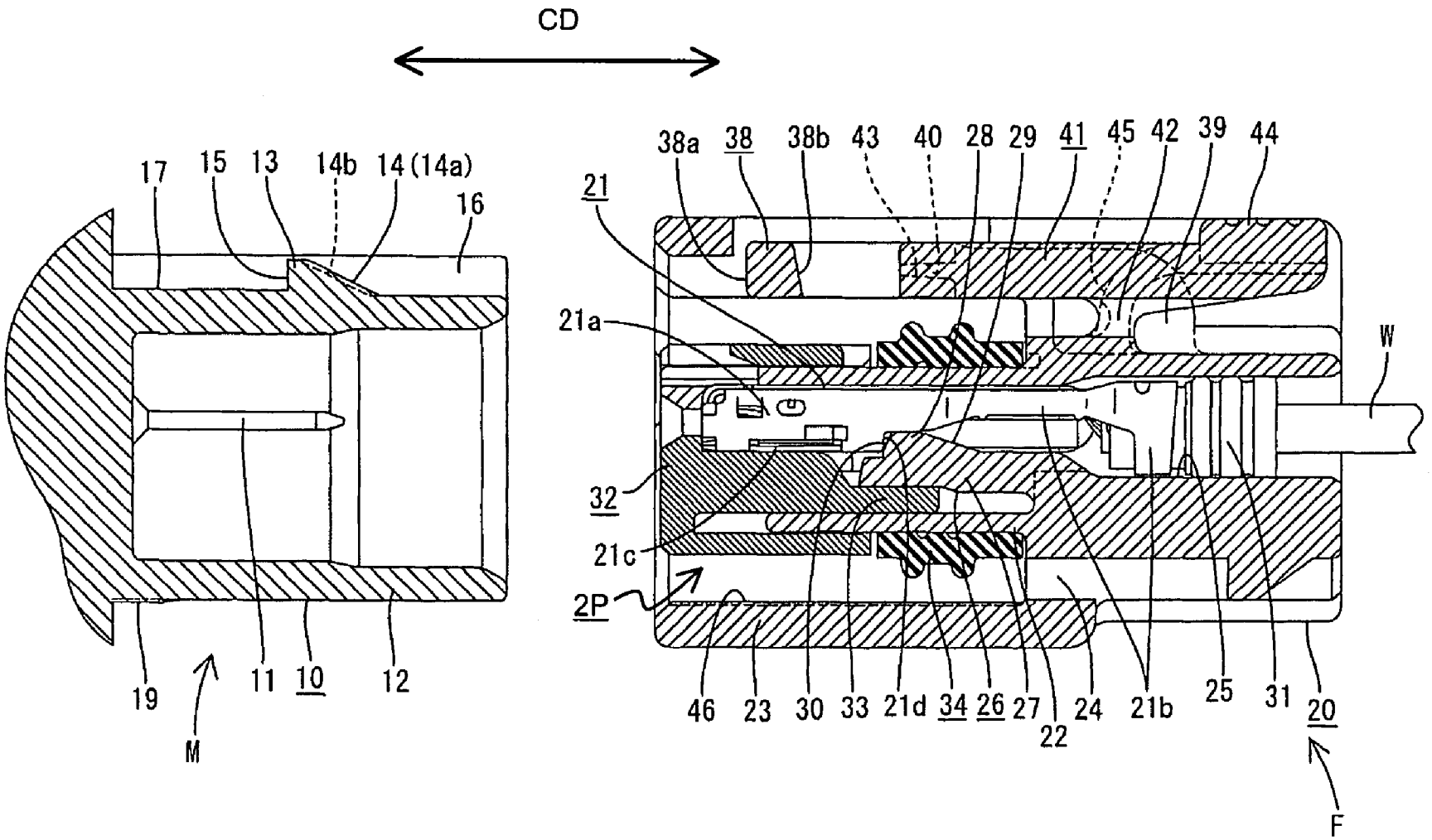
FIG. 3 is a side view in section showing a state before the female housing and a male housing are connected.
Figure 4:
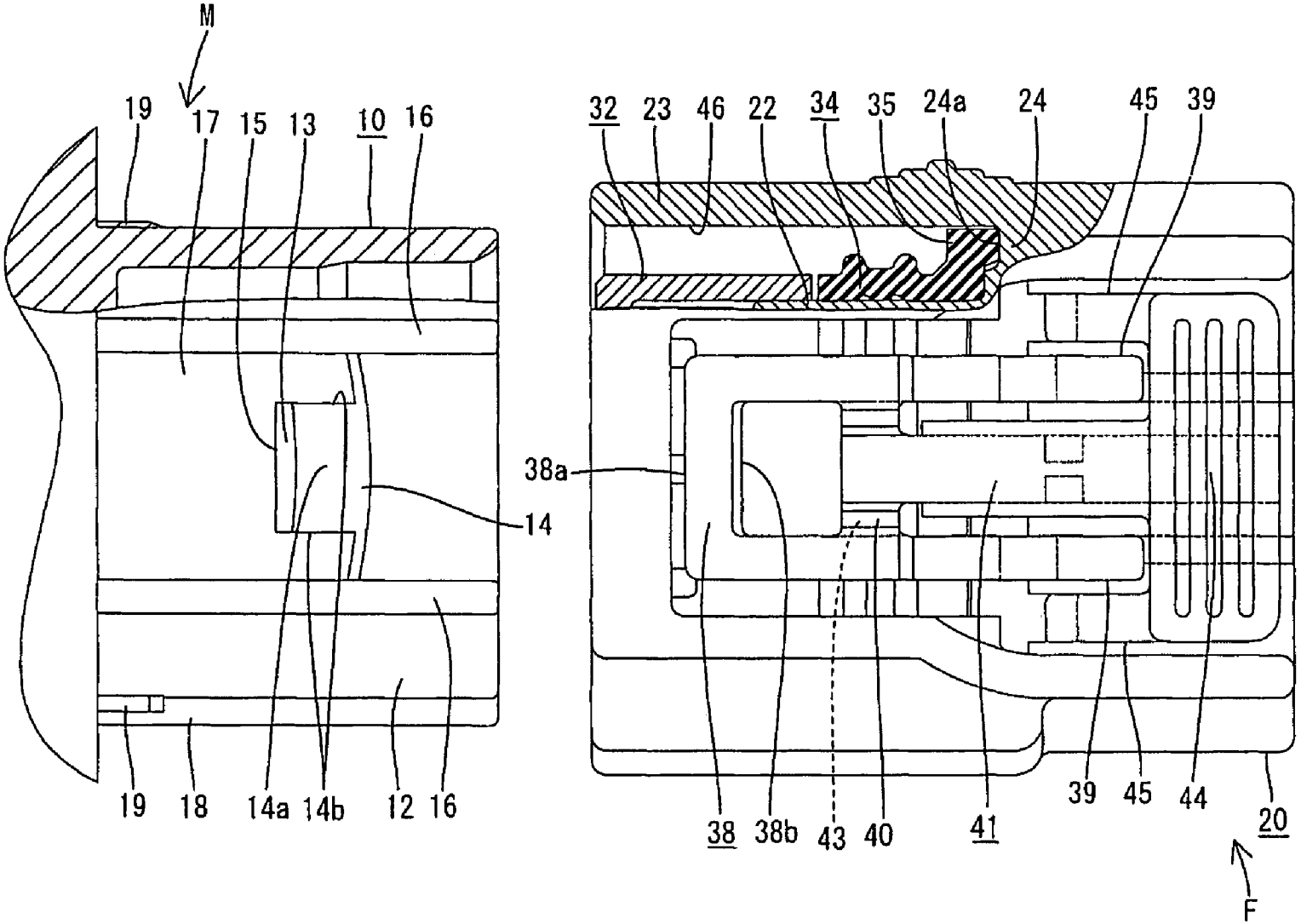
FIG. 4 is a plan view partly in section showing the state before the two housings are connected.
Figure 5:
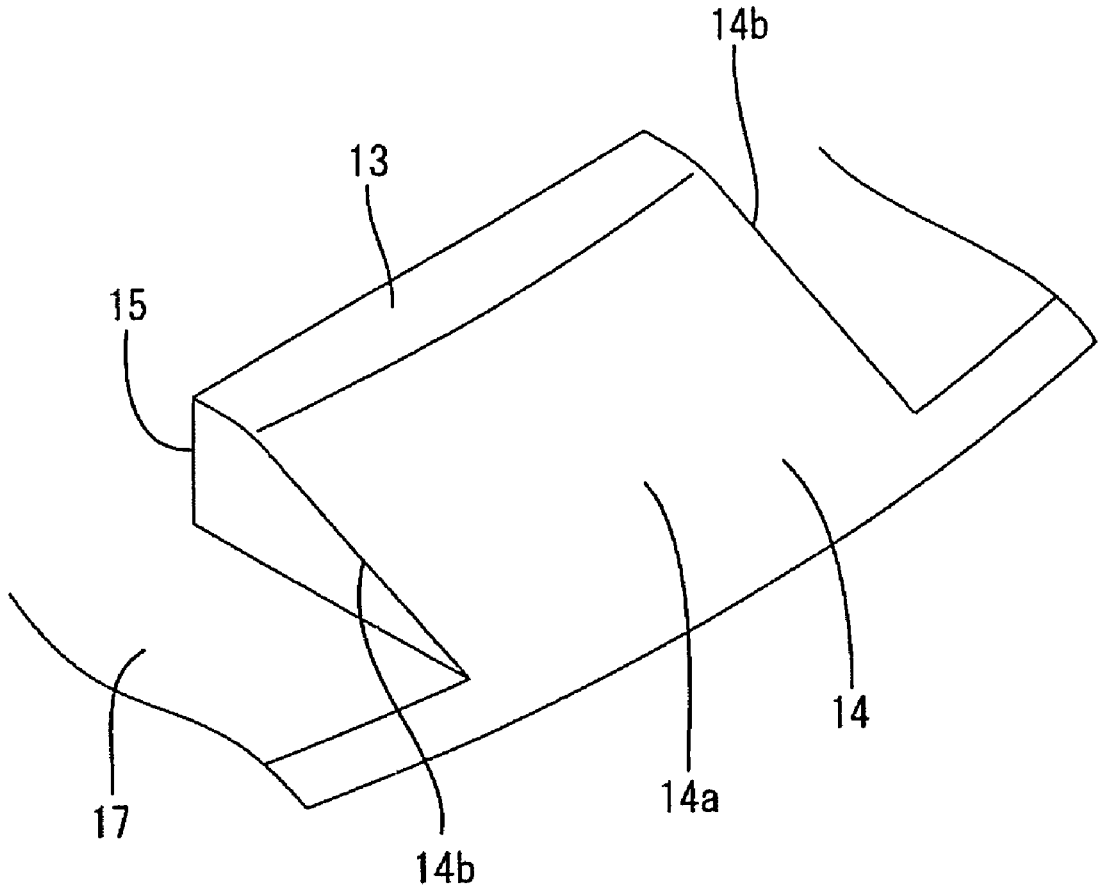
FIG. 5 is an enlarged perspective view of an interlocking portion.

The male connector M includes a synthetic resin male housing 10 that is coupled directly to a wall of an apparatus, as shown in FIGS. 1, 3 and 4. Three male terminal fittings 11 are embedded in the male housing 10 to define a substantially side-by-side array along a width direction WD. A rectangular tubular receptacle 12 of the male housing 10 projects forward from the apparatus and surrounds front ends of the male terminal fittings 11. An interlocking portion 13 projects up substantially in the widthwise middle of the upper surface of the receptacle 12. The interlocking portion 13 has a front surface 14 that slopes up and towards the back at an acute angle to the connecting direction CD. The interlocking portion 13 also has a rear surface 15 aligned substantially straight along the vertical direction and substantially normal to the connecting direction. An upper surface of the interlocking portion 13 extends substantially horizontally between the front and rear surfaces 14 and 15, and is substantially parallel to the connecting direction CD. Two guide ribs 16 are formed on the upper surface of the receptacle 12 on opposite sides of the interlocking portion 13. The guide ribs 16 guide the connection of the two housings 10, 20. A step 17 is formed behind the front end of the interlocking portion 13 and between the guide ribs 16. The step 17 is slightly higher than a front end of the upper surface of the receptacle 12. Guide ribs 18 project from the opposite outer side surfaces of the receptacle 12.

Figure 2:
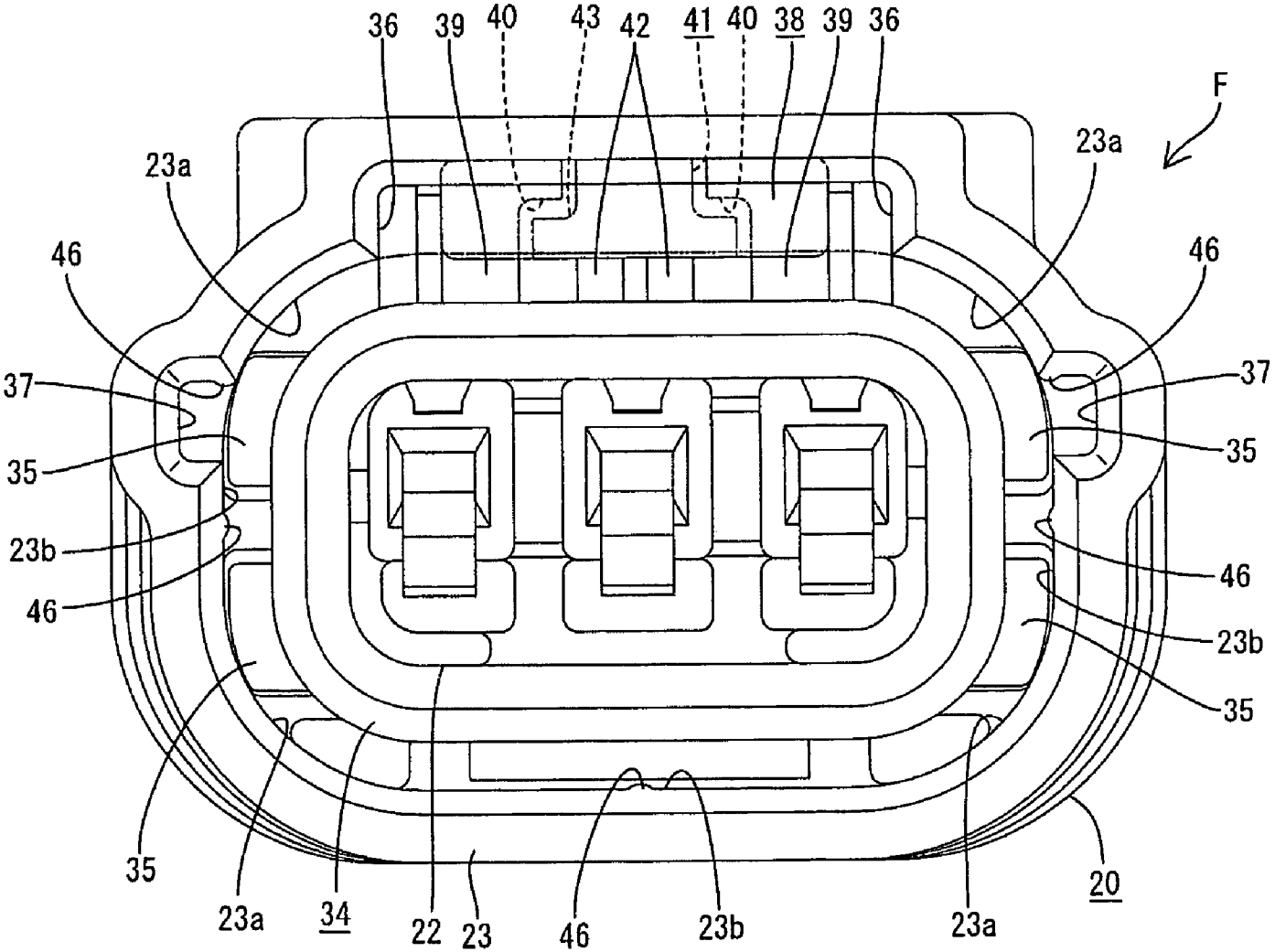
FIG. 2 is a front view of the female housing.

The female connector F has a female housing 20 made of a synthetic resin and female terminal fittings 21 connected with ends of wires W, as shown in FIGS. 2 to 4. The female housing 20 includes a terminal accommodating portion 22, and an outer tube 23 surrounding the terminal accommodating portion 22 and a coupling 24 that couples the rear end of the outer tube 23 to the terminal accommodating portion 22. The receptacle 12 of the male housing 10 fits between the terminal accommodating portion 22 and the outer tube 23 from the front, and a clearance is defined between the inner surface of the outer tube 23 and the outer surface of the receptacle 12.

The terminal accommodating portion 22 is substantially block-shaped and has three cavities 25 arranged side by side along the width direction WD. The female terminal fittings 21 are insertable into the cavities 25 from behind. A lock 26 is provided at the lower surface of each cavity 25 for engaging the corresponding female terminal fitting 21. Each lock 26 has a forwardly cantilevered arm 27 and a locking section 28 that projects into the cavity 25 from the upper surface of the arm 27. The female terminal fitting 21 presses a rear surface 29 of the locking section 28 to deform the arm 27 down about the rear end of the arm 27. The rear surface 29 of the locking section 28 is sloped up towards the front to guide a pressing movement by the female terminal fitting 21. On the other hand, the front of the locking section 28 defines a locking surface 30 for engaging the female terminal fitting 21.

Each female terminal fitting 21 has a substantially box-shaped main portion 21*a* and a barrel 21*b* coupled one after the other. The mating male terminal fitting 11 is insertable into the main portion 21*a* from the front, and a resilient contact piece (not shown) is provided in the main portion 21*a* for contacting the male terminal fitting 11. An outer wall 21*c* of the main portion 21*a* facing the lock 26 slides in contact with the rear surface 29 of the locking section 28 of the lock 26 during insertion of the female terminal fitting 21 into the cavity 25. The front surface 30 of the locking section 28 engages a rear end 21*d* when the male terminal fitting 11 is inserted properly. The barrel 21*b* includes two front crimping pieces that are crimped into connection with a core of the wire W and two rear crimping pieces that are crimped into connection with a sealing plug 31 fit on an insulation coating of the wire W. The inner surface of the sealing plug 31 closely contacts the outer surface of the insulating coating of the wire W and the outer surface of the sealing plug 31 closely contacts the inner surface of the cavity 25 to seal the cavity 25.

A front retainer 32 is mountable into the terminal accommodating portion 22 from the front and is movable along forward and backward directions between a partial locking position (see FIG. 11) and a full locking position. The front retainer 32 has a deformation-preventing portion 33 that is forward from deformation spaces for the locks 26 when the front retainer 32 is in the partial locking position. However, the deformation-preventing portion 33 enters the deformation spaces to prevent deformation of the locks 26 when the front retainer is in the full locking position. The front retainer 32 can be held at the partial locking position or the full locking position by unillustrated holding means. A seal ring 34 is fit on the outer surface of the terminal-accommodating portion 22 behind the front retainer 32. The inner surface of the seal ring 34 closely contacts the outer surface of the terminal-accommodating portion 22 while the outer surface of the seal ring 34 closely contacts the inner surface of the receptacle 12 to provide sealing between the two housings 10, 20. Two bulges 35 bulge out vertically from each of the upper and lower ends of each of the opposite outer side surfaces at the rear end of the seal ring 34 so that a total of four bulges 35 are provided. The bulges 35 can be compressed resiliently by the front end surface of the receptacle 12 of the male housing 10 during the connection. Each bulge 35 projects slightly back from the rear of the seal ring 34, and this projection is accommodated in a receiving recess 24*a* in the forwardly facing surface of the coupling 24. The front end of the front retainer 32 engages the seal ring 34 when the front retainer 32 is at the full locking position to prevent the seal ring 34 from coming out forward.

The outer tube 23 has a substantially rectangular cross-section and an open front end. Two guide grooves 36 are formed in the inner surface of the outer tube 23 for receiving the guide ribs 16 of the male housing 10. Additionally, two guide grooves 37 are formed in the opposite sides of the inner surface of the outer tube 23 for receiving the guide ribs 18. A cut-out space is formed in an upper part of the outer tube 23 behind the front end, and a lock arm 38 and an unlocking arm 41 are provided in this space. The lock arm 38 has two beams that are that are cantilevered forwardly from their base ends 39. The beams are coupled at their front ends to define a substantially U-shape in plan view. The lock arm 38 is resiliently deformable along a vertical direction intersecting the connecting directions with both base ends 39 as supports. The lock arm 38 has a substantially straight vertical front surface 38*a* that slides in contact with the front surface 14 of the interlocking portion 13 during the connecting process. The lock arm 38 also has an overhanging rear locking surface 38*b* slopes up towards the front for engagement with the rear surface 15 of the interlocking portion 13.

The unlocking arm 41 is coupled to the terminal accommodating portion 22 at a support 42 between the base ends 39 of the lock arm 38, and can undergo a seesaw-like up and down resilient deformation about the support 42. The unlocking arm 41 has an engaging portion 43 that extends forward from the support 42 for engaging the engageable portion 40 of the lock arm 38 from below. An operable portion 44 extends back from the support 42 and is pressable from above. Accordingly, when the operable portion 44 is pressed down, the engaging portion 43 is displaced up into engagement with the engageable portion 40 of the lock arm 38 to lift the lock arm 38 up and out of engagement with the interlocking portion 13. The operable portion 44 is wider than the engaging portion 43 and the support 42 and has two cantilevered auxiliary supports 45 at opposite ends thereof. The auxiliary supports 45 are coupled to the terminal-accommodating portion 22 at substantially the same position as the support 42 with respect to forward and backward directions and at lateral sides of both base ends 39 of the lock arm 38.

The front surface 14 of the interlocking portion 13 faces the lock arm 38 during the connecting operation and is moderately arcuate and inclined as described above and shown in FIGS. 4 and 5. More specifically, the arcuate front surface 14 of the interlocking portion 13 bulges forward to a largest extent at a widthwise middle 14*a* and gradually recedes back toward opposite widthwise ends 14*b*. Accordingly, only the widthwise middle portion 14*a* of the front surface 14 of the interlocking portion 13 slides in contact with a widthwise middle of the lock arm 38 during the connecting process and other parts of this front surface do not contact the lock arm 38. A sliding contact area of the front surface 14 of the interlocking portion 13 with the lock arm 38 is only the widthwise middle portion 14*a* and defines a substantially straight line extending forward and backward along the connecting direction CD of the two housings 10, 20. Accordingly, frictional resistance between the front surface 14 and the lock arm 38 is reduced as compared to a case where the entire front surface of the interlocking portion slides in contact and this sliding contact area forms a surface extending along forward and backward directions. The front end surface of the step 17 that slides in contact with the lock arm 38 during the connecting process also is arcuate and is continuous with the front surface 14 of the interlocking portion 13.

Male-side loose movement restrictions 19 bulge out from the outer surface of the receptacle 12 of the male housing 10, as shown in FIG. 1. More specifically, the outer surface of the receptacle 12 of the male housing 10 has four curved corners 12*a* connected by substantially straight surfaces 12*b*. The guide ribs 18 project immediately below the opposite upper curved corners 12*a*. The male-side loose movement restrictions 19 are provided at upper ends of the vertical straight surfaces 12*b*, and at a substantially middle position of the lower straight surface 12*b* extending along horizontal direction and at the upper surfaces of both guide ribs 18. The male-side loose movement restrictions 19 are substantially rectangular in front view, and the front end surfaces thereof slope up towards the back. The male-side loose movement restriction 19 at the lower surface is about twice as large as the male-side loose movement restrictions 19 on the guide ribs 18, and the male-side loose movement restrictions 19 on the side surfaces are about twice as large as the lower male-side loose movement restriction 19. A bulging distance of the respective male-side loose movement restrictions 19 is substantially equal to a clearance between the two housings 10, 20.

On the other hand, female-side loose movement restrictions 46 bulge in on the inner surface of the outer tube 23 facing the outer surface of the receptacle 12 of the female housing 20 during the connecting operation, as shown in FIG. 2. More specifically, the inner surface of the outer tube 23 has four curved corners 23*a* and straight surfaces 23*b* connecting the curved corners 23*a*, the curved corners 23*a* and the straight surfaces 23*b* extend along the outer surface of the receptacle 12. The guide grooves 37 are formed below the upper curved corners 23*a*. The female-side loose movement restrictions 46 are provided at upper ends of the opposite vertical straight surfaces 23*b*, at a substantially middle position of the lower straight surface 23*b*, and at the upper surfaces of both guide grooves 37. The respective female-side loose movement restrictions 46 are elongated projections having a substantially semicircular front view and extending along forward and backward directions over substantially the entire length of the outer tube 23. The female-side loose movement restrictions 46 are narrower than the smallest male-side loose movement restrictions 19 at the upper side. A bulging distance of the female-side loose movement restrictions 46 is substantially equal to the clearance between the two housings 10, 20. The female-side loose movement restrictions 46 are displaced from the respective bulges 35 of the seal ring 34 to prevent interference of the female-side loose movement restrictions 46 with the bulges 35 during the mounting of the seal ring 34 can be prevented.

As shown in FIGS. 3 and 4, the male-side loose movement restrictions 19 are about ⅙ the width of the receptacle 12, and are arranged only at the rear end of the receptacle 12 along a connection area of the outer surface of the receptacle 12 with the female housing 20. Accordingly, upon entering a final stage of the process of connecting the two housings 10, 20, the female-side loose movement restrictions 46 interfere with the male-side loose movement restrictions 19.

Figure 6:
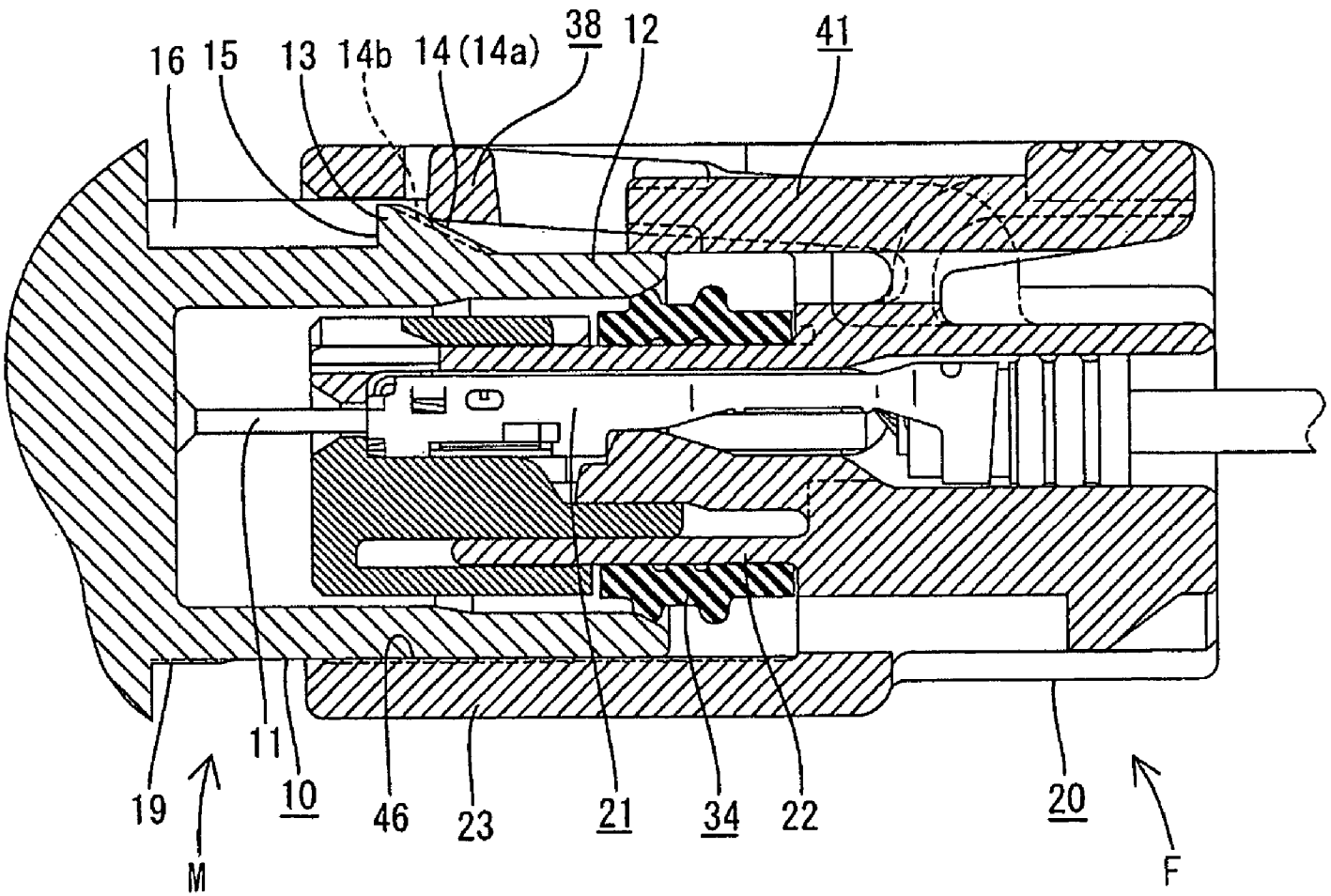
FIG. 6 is a side view in section showing an intermediate state of the connection of the two housings.

The receptacle 12 of the male housing 10 is fit between the terminal accommodating portion 22 of the female housing 20 and the outer tube 23 from a state shown in FIGS. 3 and 4. Thus, the respective guide ribs 16, 18 enter the corresponding guide grooves 36, 37 to guide the connecting operation. When the two housings 10, 20 are connected to a specified depth, the front surface 38*a* of the lock arm 38 slides in contact the front surface 14 of the interlocking portion 13, as shown in FIG. 6. The widthwise middle 14*a* of the arcuate front surface 14 of the interlocking portion 13 is linear along forward and backward directions and slides in sliding contact with the lock arm 38. Thus, a frictional resistance force created between the front surface 14 and the lock arm 38 is reduced as compared to a case where the lock arm is held in surface contact with the front surface of the interlocking portion over an entire width area. Further, both guide ribs 16 inserted at the sides of the lock arm 38 slide in contact with the opposite side surfaces of the lock arm 38 in this process. Thus, the lock arm 38 will not incline with respect to widthwise direction even through the sliding contact area with the interlocking portion 13 is linear along forward and backward directions.

Figure 7:
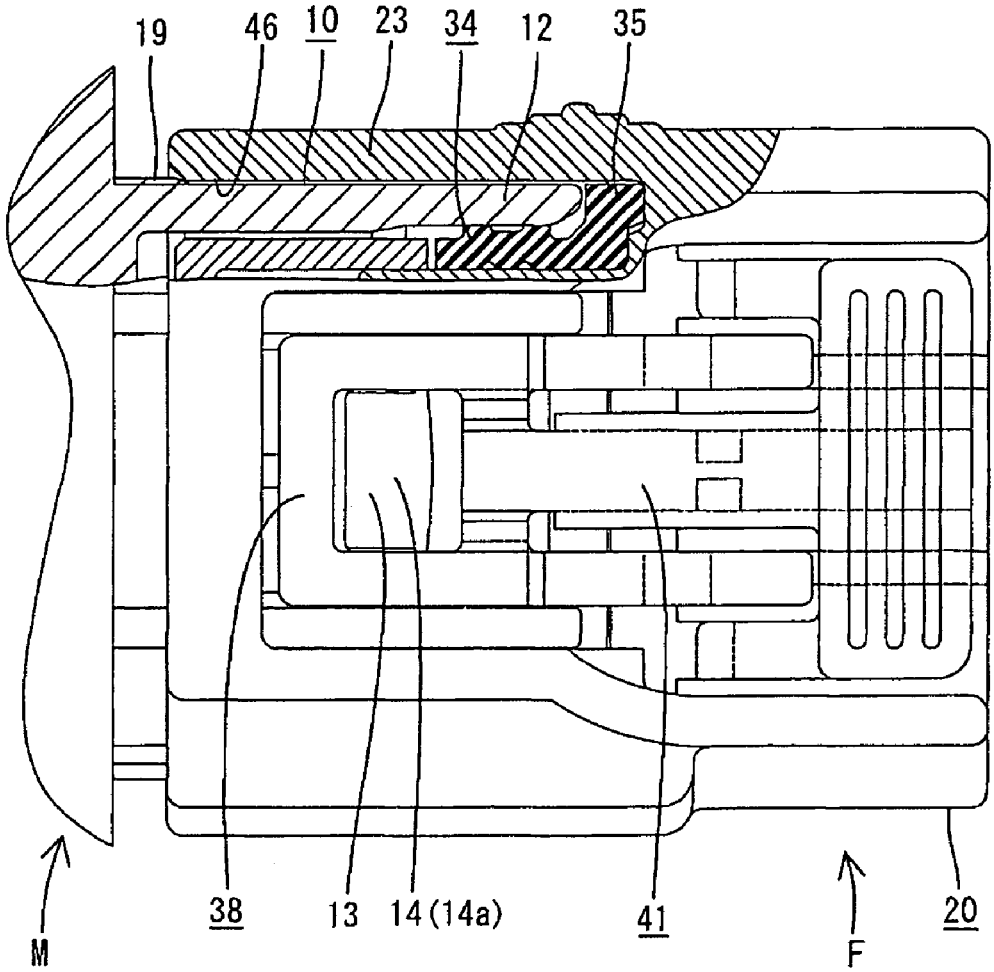
FIG. 7 is a plan view partly in section showing the intermediate state of the connection of the two housings.

The outer surface of the seal ring 34 contacts the inner surface of the receptacle 12 when the connecting operation proceeds to the stage shown in FIG. 7. The male-side loose movement restrictions 19 and the female-side loose movement restrictions 46 interfere with each other and are squeezed against each other as the connecting operation proceeds farther. Squeezed amounts of the respective loose movement restrictions 19, 46 are substantially constant since the loose movement restrictions 19, 46 are on the straight surfaces 12*b*, 23*b* of the receptacle 12 and the outer tube 23. Simultaneously, the front end surface of the receptacle 12 contacts the bulges 35 of the seal ring 34, and the bulges 35 are compressed resiliently between the coupling 24 and the receptacle 12.

Figure 8:
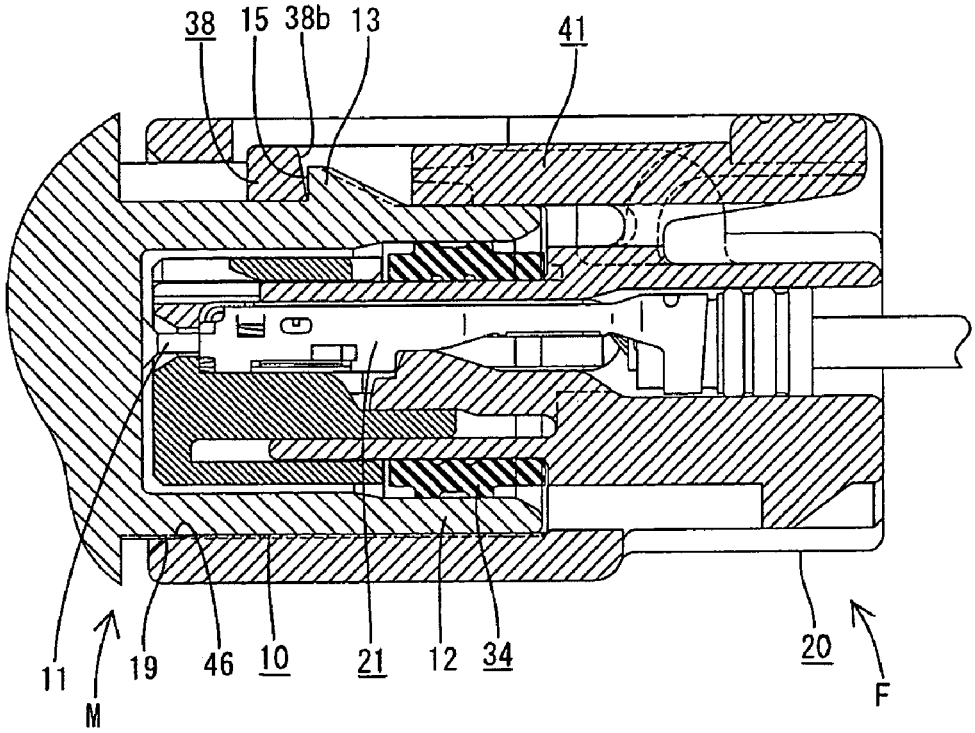
FIG. 8 is a side view in section showing a state where the two housings are properly connected.
Figure 9:
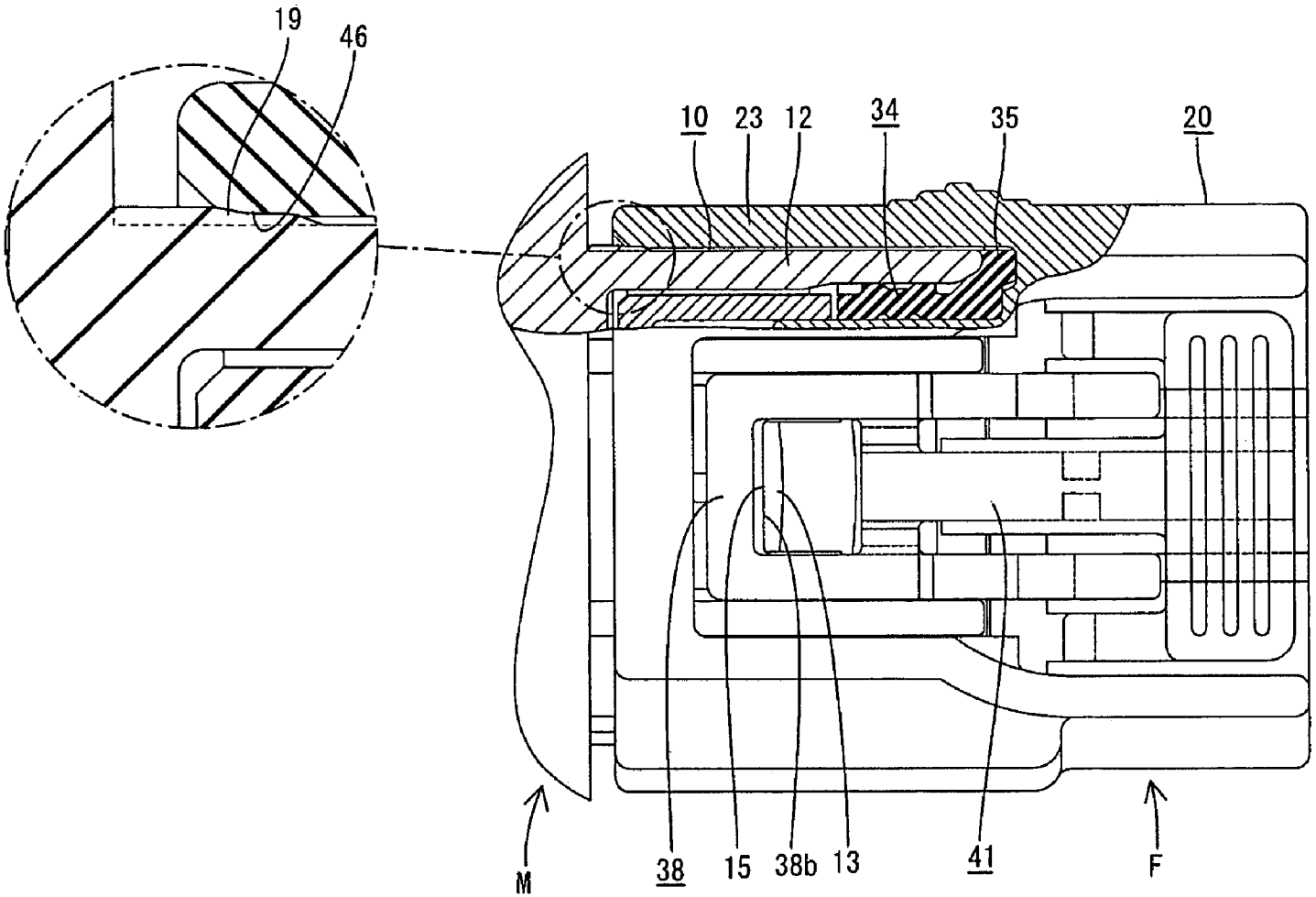
FIG. 9 is a plan view partly in section showing the state where the two housings are properly connected.

The lock arm 38 moves over the interlocking portion 13 and then restores resiliently when the housings 10, 20 are connected to a proper depth, as shown in FIGS. 8 and 9. At this time, the lower surface of the front end of the lock arm 38 collides with the step 17 that is raised slightly from the upper surface of the receptacle 12. Thus, a large striking sound is generated and an operator knows that the proper connection has been reached. The lock arm 38 remains slightly deformed on the step 17, and is not restored completely to an unbiased state. The housings 10, 20 are held in their properly connected state by the engagement of the rear surface 38*b* of the lock arm 38 and the rear surface 15 of the interlocking portion 13. Further, the male and female terminal fittings 11, 21 are connected electrically. The bulges 35 are compressed resiliently to bias the two housings 10, 20 in separating directions in this properly connected state. Thus, the lock arm 38 and the interlocking portion 13 are held in contact without shaking in forward and backward directions. Further, the inner surface of the front end of the receptacle 12 closely contacts the outer surface of the seal ring 34, including the compressed bulges 35, and the male-side loose movement restrictions 19 at the rear end of the receptacle 12 closely contact the female-side loose movement restrictions 46. Thus, the two housings 10, 20 are prevented from moving loosely in directions intersecting the connecting and separating directions CD over substantially the entire length. Accordingly, even if the connector is used in a high vibration environment, such as in an engine compartment of an automotive vehicle, the two housings 10, 20 will not shake with respect to each other due to vibration and the connected terminal fittings will not abrade against each other.

As described above, the front surface 14 of the interlocking portion 13 is arcuate and the widthwise middle portion 14*a* of the front surface slides in contact with the lock arm 38. Thus, the sliding contact area is smaller than the width of the front surface 14 of the interlocking portion 13, thereby reducing a frictional resistance force created between the front surface 14 and the lock arm 38 during the connecting process. As a result, connecting efficiency is improved. Further, the widthwise middle portion 14*a* is linear along forward and backward directions. Thus, the frictional resistance force is smaller.

The male-side loose movement restrictions 19 bulge out from the outer surface of the receptacle 12 of the male housing 10. Thus, the housings 10, 20 will not make loose movements in directions intersecting the forward and backward directions when the male-side loose movement restrictions 19 contact the female-side loose movement restrictions 46 on the inner surface of the outer tube 23. Further, the male-side loose movement restrictions 19 are at the rear end of the connection area with the female housing 20. Thus, contact of the male-side loose movement restrictions 19 and the female-side loose movement restrictions 46 increases the connecting force only at the final stage of the connecting process. Thus, any deterioration of the connection efficiency is minimal.

The male-side loose movement restrictions 19 are only on the straight surfaces 12*b*. Thus, it is easier to control the dimensions of the male-side loose movement restrictions 19 and to control a contact pressure on the male housing 20 during the connecting operation as compared to a case where the male-side loose movement restrictions are on the curved surfaces 12*a*.

The bulges 35 of the seal ring 34 are compressed resiliently by the front end of the receptacle 12 during the connecting operation. Thus, the rear end and the front end of the receptacle 12 are prevented from making loose movements in directions intersecting with forward and backward directions by the male-side loose movement restrictions 19 and the bulges 35. Thus, the male housing 10 will not move loosely in directions intersecting the forward and backward directions over substantially the entire length. Furthermore, the two housings 10, 20 also are prevented from making loose movements along forward and backward directions by the bulges 35.

A second embodiment of the invention is described with reference to FIGS. 10 to 13. In the second embodiment, the invention is applied to the locks 26 for locking the female terminal fittings 21 in the female connector F. Elements of the second embodiment that are similar to the first embodiment are identified by the same reference numerals, but are not described again.

Figure 10:
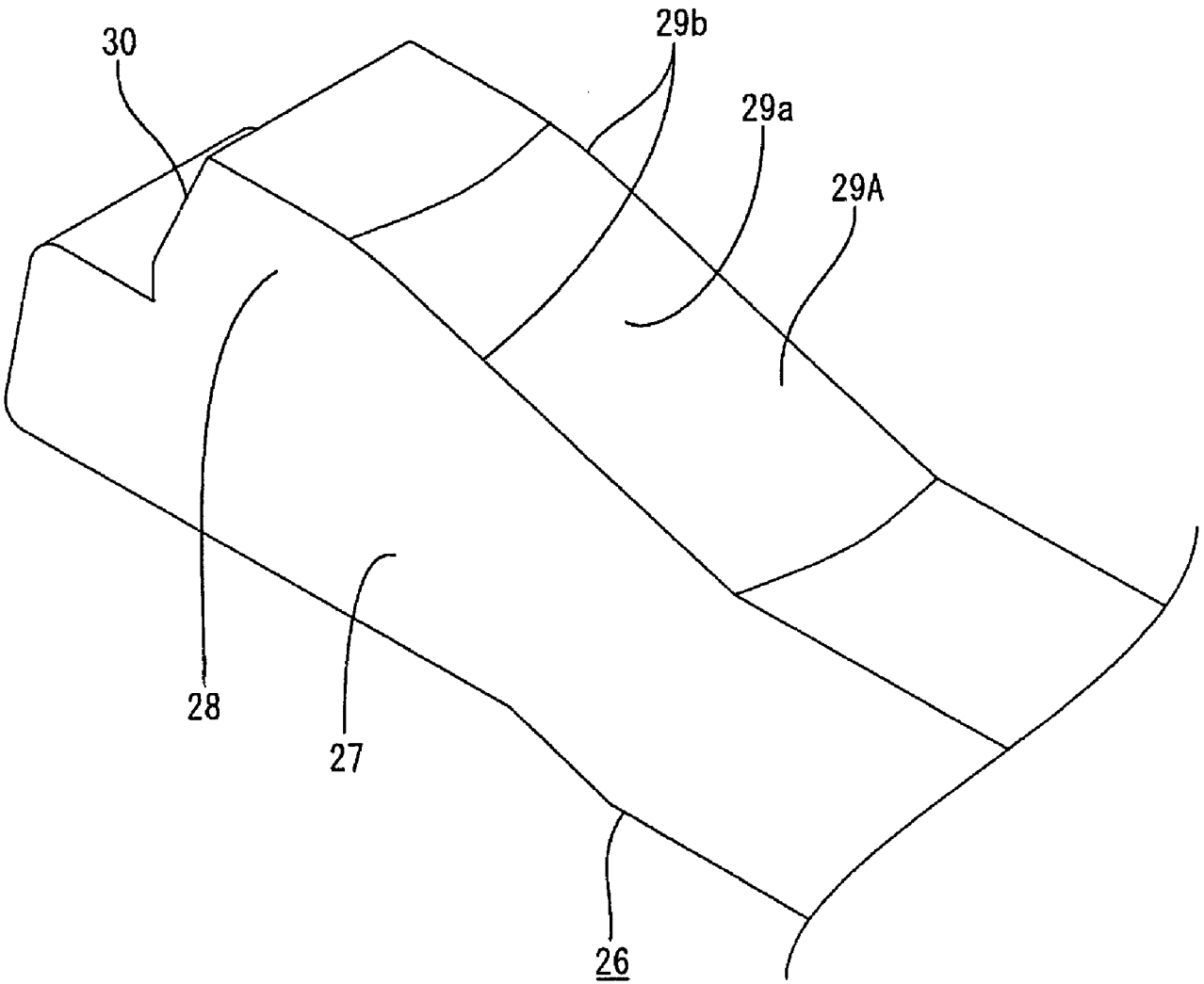
FIG. 10 is an enlarged perspective view of a locking portion according to a second embodiment of the invention.

As shown in FIG. 10, a rear surface 29A of the locking section 28 facing the outer wall 21*c* of the female terminal fitting 21 is moderately arcuate and slopes up towards the front. More specifically, the rear surface 29A of the locking section 28 bulges out forward to a largest extent at a widthwise middle 29*a* and gradually recedes forward toward opposite sides 29*b*.

Figure 11:
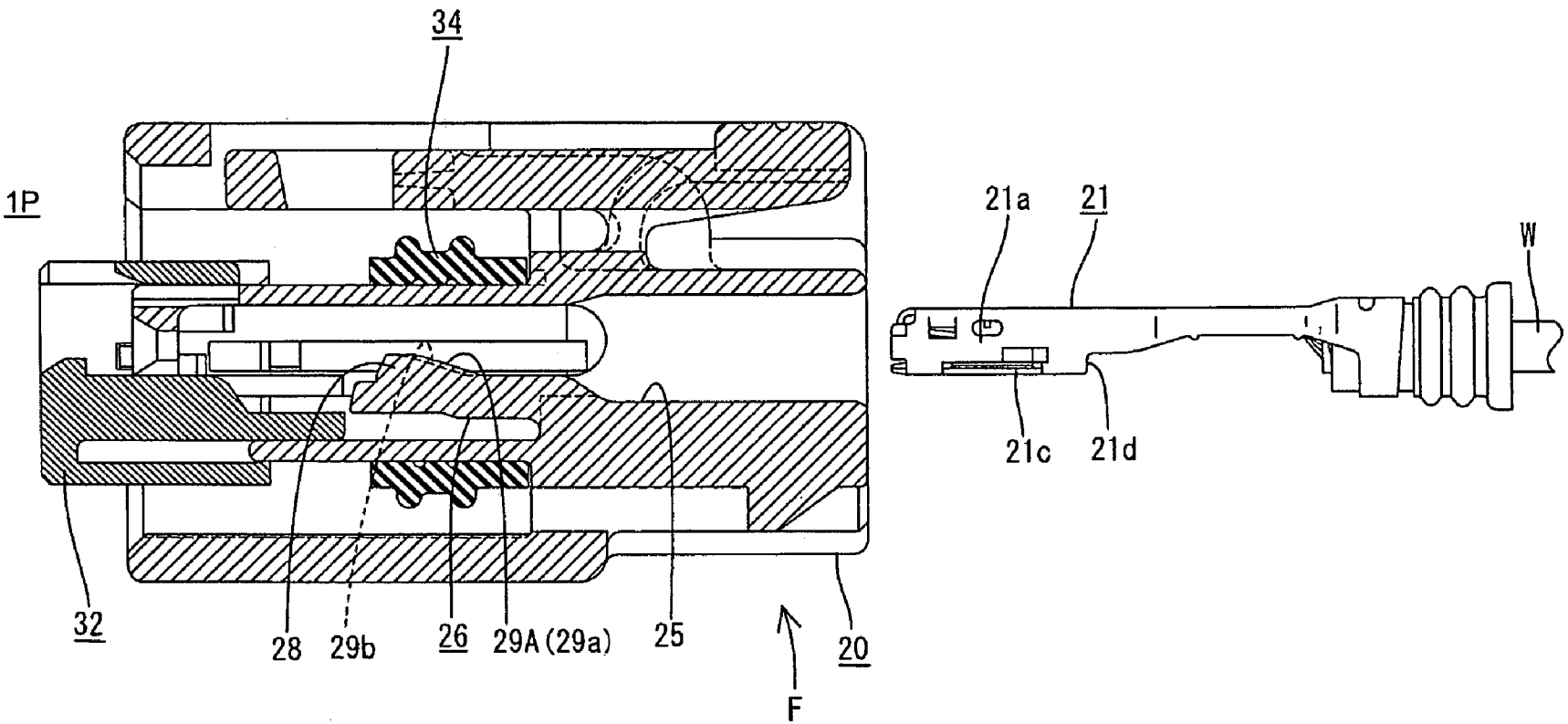
FIG. 11 is a side view in section showing a state before a female terminal fitting is inserted.
Figure 12:
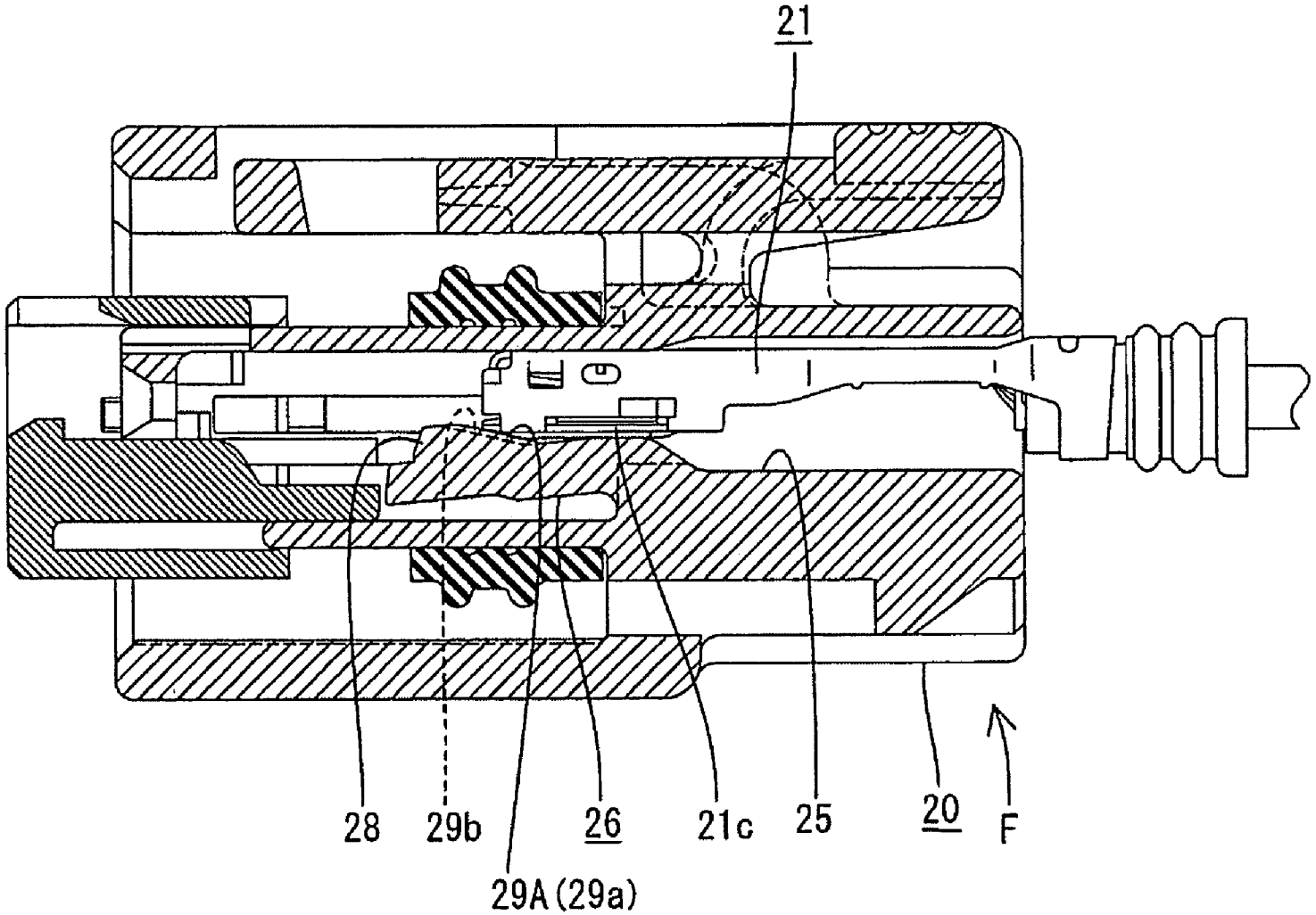
FIG. 12 is a side view in section showing an intermediate state of the insertion of the female terminal fitting.

The female connector F is assembled by mounting the seal ring 34 into the female housing 20 and mounting the front retainer 32 at the partial locking position, as shown in FIG. 11. The terminal fittings 21 connected with ends of the wires W then are inserted into the corresponding cavities 25 from behind. During the inserting process, the outer wall 21*c* of the main portion 21*a* slides in contact with the substantially linear widthwise middle 29*a* of the rear surface 29A of the locking section 28 and temporarily deforms the lock 26 down, as shown in FIG. 12. Other parts of the rear surface 29A do not contact the terminal fitting 21. Accordingly, a sliding contact area is small and frictional resistance between the rear surface 29A and the outer wall 21*c* is smaller than in a case where the outer wall 21*c* comes into surface contact with the entire width of the rear surface of the locking section. Therefore, a force needed to insert the female terminal fitting 21 into the cavity 25 is reduced.

Figure 13:
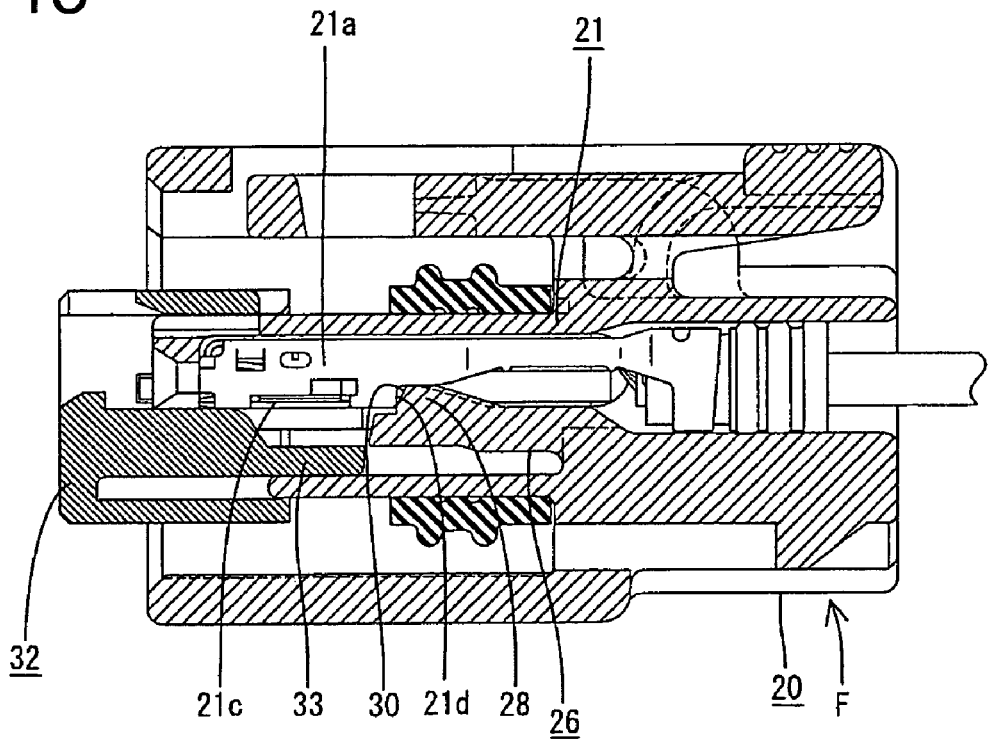
FIG. 13 is a side view in section showing a state where the female terminal fitting is properly inserted.

The lock 26 resiliently restores when the female terminal fitting 21 reaches a proper depth and the front surface 30 engages the rear end 21*d* of the main portion 21*a* to lock the female terminal fitting 21, as shown in FIG. 13. Thereafter, the front retainer 32 is pushed to the full locking position and the deformation-preventing portion 33 enters the deformation space for the lock 26 to prevent deformation of the lock 26. As a result the female terminal fitting 21 is locked doubly.

As described above, the rear surface 29A of the locking section 28 is arcuate and the widthwise middle portion 29*a* slides in contact with the outer wall 21*c*. Thus, the sliding contact area is smaller than the width of the rear surface 29A of the locking section 28, and a frictional resistance force between the rear surface 29A and the outer wall 21*c* during the inserting process is reduced. As a result, inserting operability can be improved. Further, the widthwise middle portion 29*a*, as the sliding contact area, is linear along forward and backward directions, the frictional resistance is minimal.

A third embodiment of the invention is described with reference to FIG. 14 or 15. In the third embodiment, the shapes of a front surface 14B of the interlocking portion 13 and a rear surface 29B of the locking portion 26 are changed. In the third embodiment, no repeated description is given on the same construction as the first and second embodiments by identifying it by the same reference numerals.

Figure 14:
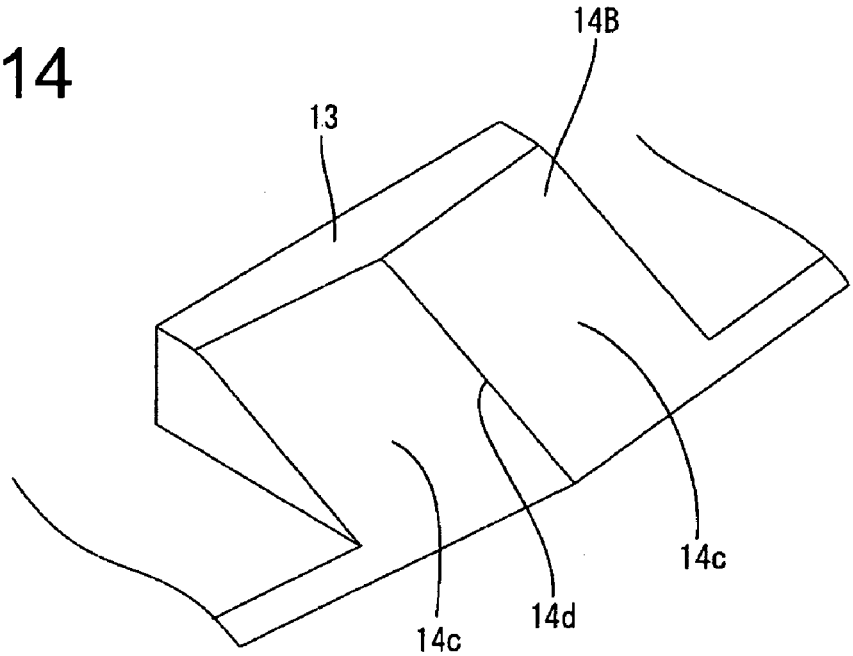
FIG. 14 is an enlarged perspective view of an interlocking portion according to a third embodiment of the invention.

As shown in FIG. 14, the front surface 14B of the interlocking portion 13 is sloped up toward the back and is formed by two flat surfaces 14*c* that bulge out forward to a largest extent at a widthwise middle of the front surface 14B. The flat surfaces 14*c* are inclined to recede gradually back toward the opposite lateral sides. A ridge 14*d* is defined by the intersection of the two flat surfaces 14*c* and is located more forward than other parts. The ridge 14*d* is linear along forward and backward directions while defining a point along the width direction WD. Accordingly, the lock arm 38 slides in contact only with the ridge 14*d* between the two flat surfaces 14*c* and does not contact other parts of the two flat surfaces 14*c* during the connection process. Thus, frictional resistance is low and operational efficiency is improved.

Figure 15:
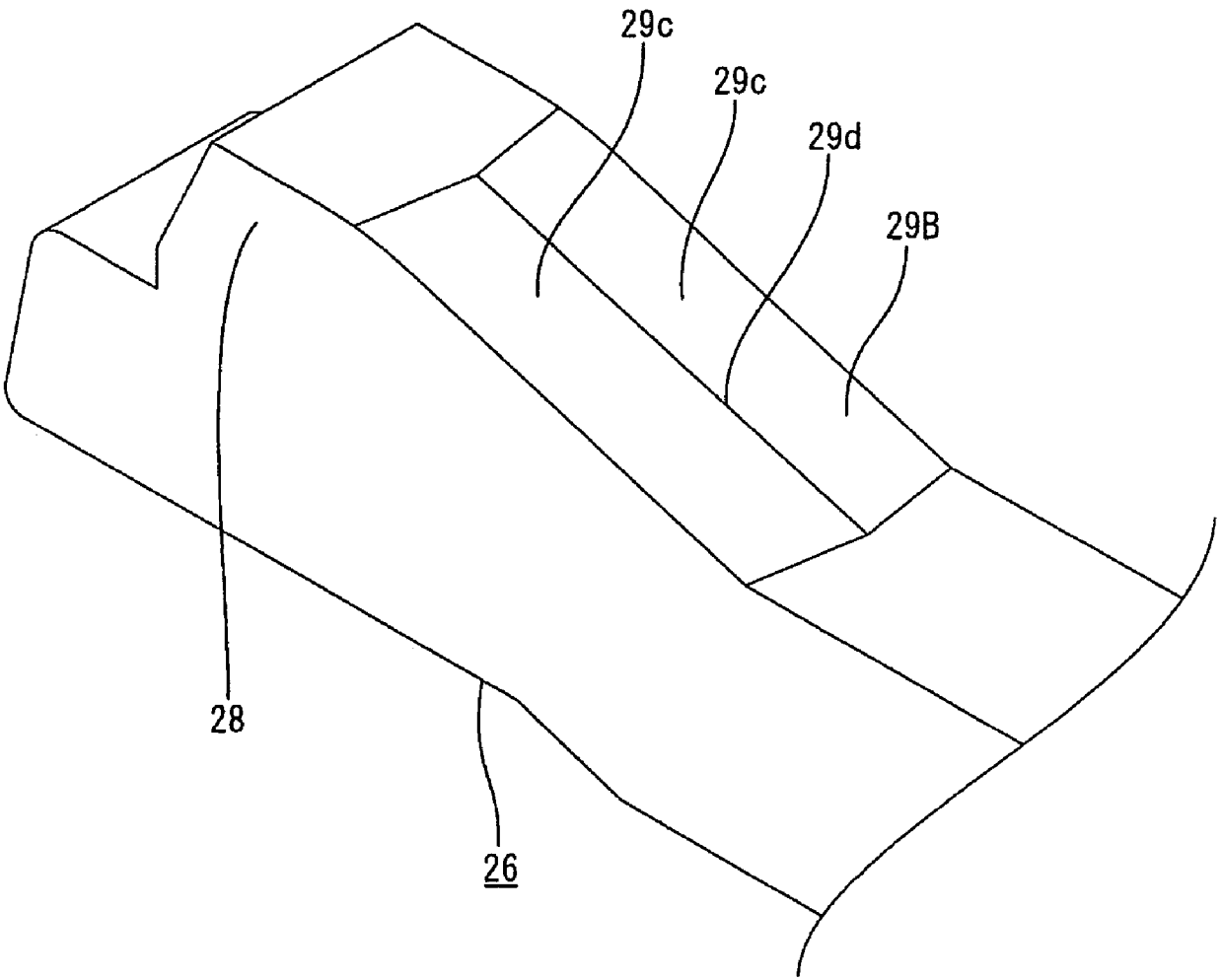
FIG. 15 is an enlarged perspective view of a locking portion.

On the other hand, as shown in FIG. 15, the rear surface 29B of the locking section 28 of the lock 26 slopes up towards the front and is formed by two flat surfaces 29*c* that bulge out backward to a largest extent at a widthwise middle of the rear surface 29B. The flat surfaces 29*c* are inclined to recede gradually forward toward the opposite lateral sides. A ridge 29*d* is defined at the intersection of the two flat surfaces 29*c* is located at a position more backward than other parts. The ridge 29*d* is linear along forward and backward directions, but defines a point along the width direction WD. Accordingly, the outer wall 21*c* of the terminal fitting 21 slides in contact only with the linear ridge 29*d* between the two flat surfaces 29*c* during the insertion of the female terminal fitting 21 into the cavity 25, and does not contact the two flat surfaces 29*c*. Thus, frictional resistance is low and operational efficiency is improved.

Further, the flat surfaces 14*c* on the front 14B of the interlocking portion 13 and the flat surfaces 29*c* on the rear 29B of the locking section 28 are easier to form and have a better dimensional precision upon resin-molding the male housing 10 and the female housing 20 as compared to a case where the arcuate surfaces are formed as in the first and second embodiments.

The invention is not limited to the above described and illustrated embodiments. For example, the following embodiments are also embraced by the technical scope of the present invention as defined by the claims. Beside the following embodiments, various changes can be made without departing from the scope and spirit of the present invention as defined by the claims.

In the first embodiment, the lock arm may have the arcuate surface. Similarly in the second embodiment, the terminal fitting may have the arcuate surface. Further in the third embodiment, the lock arm and the terminal fitting may have two flat surfaces.

In the third embodiment, the interlocking portion may have the arcuate surface and the lock may have two flat surfaces or vice versa. Further in the third embodiment, only either one of the interlocking portion and the lock may have two flat surfaces.

In the foregoing embodiments, the arcuate surface or two flat surfaces may also be provided on the upper surface of the interlocking portion and/or the locking section of the lock for sliding contact with the mating parts.

In the first and second embodiments, a wavy curved surface may, for example, be provided instead of the arcuate surface, thereby providing the partial sliding contact portions at a plurality of positions.

In the third embodiment, three or more flat surfaces may be formed on the front of the interlocking portion and/or the rear of the lock, thereby providing a plurality of meeting portions of the flat surfaces. In such a case, the sliding contact area may be a surface along forward and backward directions provided that it partly comes into sliding contact with the mating part.

The forms of the lock arm and the interlocking portion may be changed. For example, the male housing may have the lock arm while the female housing may have the interlocking portion, or the unlocking arm may be dispensed with. Similarly, the forms of the lock and the terminal fitting may be changed. Further, male terminal fittings may be accommodated in the male housing, and the invention may be applied to locks in the male housing. The invention is also applicable to nonwatertight connectors.

The number, positions and shapes of the loose movement preventing portions may be changed in the foregoing embodiments. Alternatively, the loose movement preventing portions may be dispensed with.

What is claimed is:

1. A connector, comprising:

first and second housings connectable with each other along a connecting direction;

an interlocking portion provided on the first housing;

a resiliently deformed lock arm provided on the second housing, the lock arm being configured to be deformed in a deformation direction by sliding contact with the interlocking portion during connection of the housing, the deforming direction and the connecting direction being angularly aligned to one another and defining a plane, the lock arm being restored resiliently to engage the interlocking portion when the housings are connected properly; and a substantially linear partial sliding contact area provided on at least one of the lock arm and the interlocking portion for substantially sliding line contact with a mating facing surface on the other of the lock arm and the interlocking portion during connection, the substantially linear partial sliding contact area being in the plane defined by the connecting direction and the deformation direction whereby frictional resistance between facing surfaces of the lock arm and the interlocking portion during the connecting process is reduced.

2. The connector of claim 1, wherein the interlocking portion has at least one arcuate area, the partial sliding contact surface being a linear area intermediate two arcuate areas and being configured for sliding contact with the mating facing surface along a connecting direction of the housings.

3. The connector of claim 1, wherein each of the lock arm and the interlocking portion are formed by connecting a plurality of flat surfaces, and the partial sliding contact surface is a meeting portion of the flat surfaces configured and disposed for sliding contact with the mating facing surface.

4. The connector of claim 1, wherein the first housing is fittable into the second housing, and at least one loose movement preventing portion bulges out on a surface of at least one of the first and second housings at a rear end of a connection area of the housings, the loose movement preventing portion being dimensioned for contacting an opposed surface when the housings are connected for preventing the housings from making loose movements in directions intersecting connecting direction of the housings.

5. The connector of claim 4, wherein the outer surface of the first housing has a plurality curved corner surfaces and a plurality of substantially straight surfaces connecting adjacent curved corner surfaces, the loose movement preventing portion being on at least one of the straight surfaces.

6. The connector of claim 5, wherein the second housing has a resilient member disposed for being compressed by a front end of the first housing when the housings are connected, the resilient member being configured for preventing the housings from making loose movements in directions parallel to the connecting direction and in the directions intersecting the connecting direction.

7. The connector of claim 4, wherein the at least one loose movement preventing portion comprises two loose movement preventing portions at two transversely spaced positions on a first straight surface of the first housing and a third loose movement preventing portion at a substantially middle position on a straight surface of the first housing substantially opposite the first straight surface.

8. A connector;

a first housing and a second housing configured so that the first housing is fittable into the second housing along a connecting direction, the second housing having two substantially opposed guide grooves with surfaces aligned substantially along the connecting direction, the first housing having guide ribs with surfaces aligned substantially along the connecting direction, at least one loose movement preventing portion on surfaces of at least one of the guide grooves and the guide ribs at a rear end of a connection area of the housings, the loose movement preventing portion being dimensioned for contacting an opposed surface when the housings are connected for preventing the housings from making loose movements in directions intersecting the connecting direction of the housings;

an interlocking portion provided on the first housing;

a resiliently deformable lock arm provided on the second housing, the lock arm being configured to be deformed by sliding contact with the interlocking portion during connection of the housings, the lock arm being restored resiliently to engage the interlocking portion when the housings are connected properly; and a partial sliding contact surface provided on at least one of the lock arm and the interlocking portion for sliding contact with a mating facing surface on the other of the lock arm and the interlocking portion during connection.

9. The connector of claim 4, wherein the at least one loose movement preventing portion comprises plural loose movement preventing portions disposed on straight surfaces of at least one of the first and second housings.

10. A connector, comprising:

a first component having an engageable portion formed thereon;

a second component interengageable with the first component along a connecting direction, the second component having resiliently deformable lock configured for contact with the engageable portion of the first component as the first and second components are being interengaged, such that the resiliently deformable lock is deformed in a deforming direction by the contact with the engageable portion as the first and second components are being interengaged and resiliently returns to lock the first component when the first and second components are interengaged properly, the connecting direction and the deforming direction being aligned to intersect one another for defining a plane, wherein at least one of the engageable portion and the lock has a substantially linear partial sliding contact area disposed substantially in the plane defined by the connecting direction and the deforming direction and configured to achieve a substantially sliding line contact with the other of the engageable portion and the lock for generating the deflection of the lock as the first and second components are being interengaged whereby friction resistance between facing surfaces of the lock arm and the interlocking portion during the connecting process is reduced.

11. The connector of claim 10, wherein the partial sliding contact surface is formed on an arcuate surface of at least one of the engageable portion and the lock.

12. The connector of claim 10, wherein the partial sliding contact surface is a substantially linear ridge formed between two substantially planar surfaces of at least one of the engageable portion and the lock.

13. The connector of claim 10, wherein the first component is a first housing and the second component is a second housing, the partial sliding contact surface being formed on the engageable portion of the first housing.

14. The connector of claim 13, wherein the partial sliding contact surface (14*d*) is a substantially linear ridge (14*d*) formed between two substantially planar surfaces (14*c*) of the engageable portion (13).

15. The connector of claim 10, wherein the first component (21) is a terminal fitting (21) and the second component (20) is a housing (20) with a cavity (25) for receiving the terminal fitting (21), the resiliently deformable lock (26) being configured for locking the terminal fitting (21) in the cavity (25), the partial sliding contact surface (29*a*; 29*d*) being formed on the resiliently deformable lock (26) in the second housing (20).

16. The connector of claim 15, wherein the partial sliding contact surface (29*d*) is a substantially linear ridge (29*d*) formed between two substantially planar surfaces (29*c*) of the lock (26).

17. The connector of claim 15, wherein the partial sliding contact surface (29*a*) is formed on an arcuate surface of the lock (26).

* * * * *